US007533478B2

(12) United States Patent
Bird et al.

(10) Patent No.: US 7,533,478 B2
(45) Date of Patent: May 19, 2009

(54) CYCLING SHOE WITH AN ADJUSTABLE STRAP

(75) Inventors: Carl Bird, Aptos, CA (US); Greg Grenzke, Santa Cruz, CA (US)

(73) Assignee: Specialized Bicycle Components, Inc., Morgan Hill, CA (US)

( * ) Notice: Subject to any disclaimer, the term of this patent is extended or adjusted under 35 U.S.C. 154(b) by 449 days.

(21) Appl. No.: 11/383,992

(22) Filed: May 18, 2006

(65) Prior Publication Data

US 2007/0266595 A1 Nov. 22, 2007

(51) Int. Cl.
*A43B 5/14* (2006.01)
*A43C 11/00* (2006.01)

(52) U.S. Cl. ..... 36/50.1; 36/50.5; 36/131

(58) Field of Classification Search ..... 36/50.1, 36/50.5, 131

See application file for complete search history.

(56) References Cited

U.S. PATENT DOCUMENTS

| | | | | |
|---|---|---|---|---|
| 3,662,435 | A * | 5/1972 | Allsop | 24/70 SK |
| 4,334,368 | A * | 6/1982 | Chalmers et al. | 36/118.7 |
| 4,845,864 | A | 7/1989 | Corliss | |
| 4,972,613 | A | 11/1990 | Loveder | |
| 5,265,350 | A | 11/1993 | MacPhail | |
| 5,363,572 | A * | 11/1994 | Marega et al. | 36/118.7 |
| 6,250,651 | B1 | 6/2001 | Reuss et al. | |
| 6,446,362 | B1 * | 9/2002 | Martin et al. | 36/117.1 |
| 6,554,295 | B2 * | 4/2003 | Rittmeyer | 280/11.3 |
| 6,729,047 | B2 * | 5/2004 | Hirayama | 36/50.5 |
| 2004/0143999 | A1 * | 7/2004 | Grella et al. | 36/115 |

FOREIGN PATENT DOCUMENTS

| | | |
|---|---|---|
| EP | 0400213 | 12/1990 |
| IT | 01233760 | 4/1992 |
| IT | 01291412 | 1/1999 |
| IT | 01300242 | 5/2000 |
| IT | 01306623 | 10/2001 |
| IT | 00247762 | 9/2002 |
| IT | 01317314 | 6/2003 |
| IT | 01323896 | 10/2004 |
| IT | 01323911 | 10/2004 |
| WO | WO 94/27456 | 12/1994 |

OTHER PUBLICATIONS

SIDI USA, Cycling Shoe from website, www.sidiusa.com, 3 pages, accessed Mar. 29, 2006.

* cited by examiner

*Primary Examiner*—Ted Kavanaugh
(74) *Attorney, Agent, or Firm*—Michael Best & Friedrich LLP

(57) ABSTRACT

A shoe that includes an upper defining a heel, a strap adjuster member coupled to the upper, and a strap that extends across a portion of the upper. The strap is coupled to the adjuster member such that at least a portion of the strap is movable in one of a direction toward and away from the heel.

16 Claims, 5 Drawing Sheets

CYCLING SHOE WITH AN ADJUSTABLE STRAP

BACKGROUND

The present invention relates to cycling shoes, and more particularly to a tightening system for cycling shoes.

Cycling shoes can be worn by a rider of a bicycle to couple the rider's feet to the pedals of the bicycle. Generally, a cycling shoe includes a cleat on the bottom of the sole that engages a pedal of the bicycle to couple the shoe to the pedal. In one arrangement, the rider can uncouple the shoe from the pedal by laterally rotating their heel to a predetermined angle relative to the pedal which results in the disengagement of the shoe from the pedal.

In order to secure the shoe to the user's foot, cycling shoes typically include a tightening system. One such tightening system utilizes VELCRO straps, and other applications utilize a ratchet that can tighten a strap that extends across the shoe.

SUMMARY

The present invention provides a shoe that includes an upper defining a heel, an adjuster member coupled to the upper, and a strap that extends across a portion of the upper. The strap is coupled to the adjuster member such that at least a portion of the strap is movable in one of a direction toward and away from the heel.

In another aspect of the present invention the strap is coupled to the upper in one of a first position and a second position. The first position is closer to the heel than the second position.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

DETAILED DESCRIPTION

Figure 1:
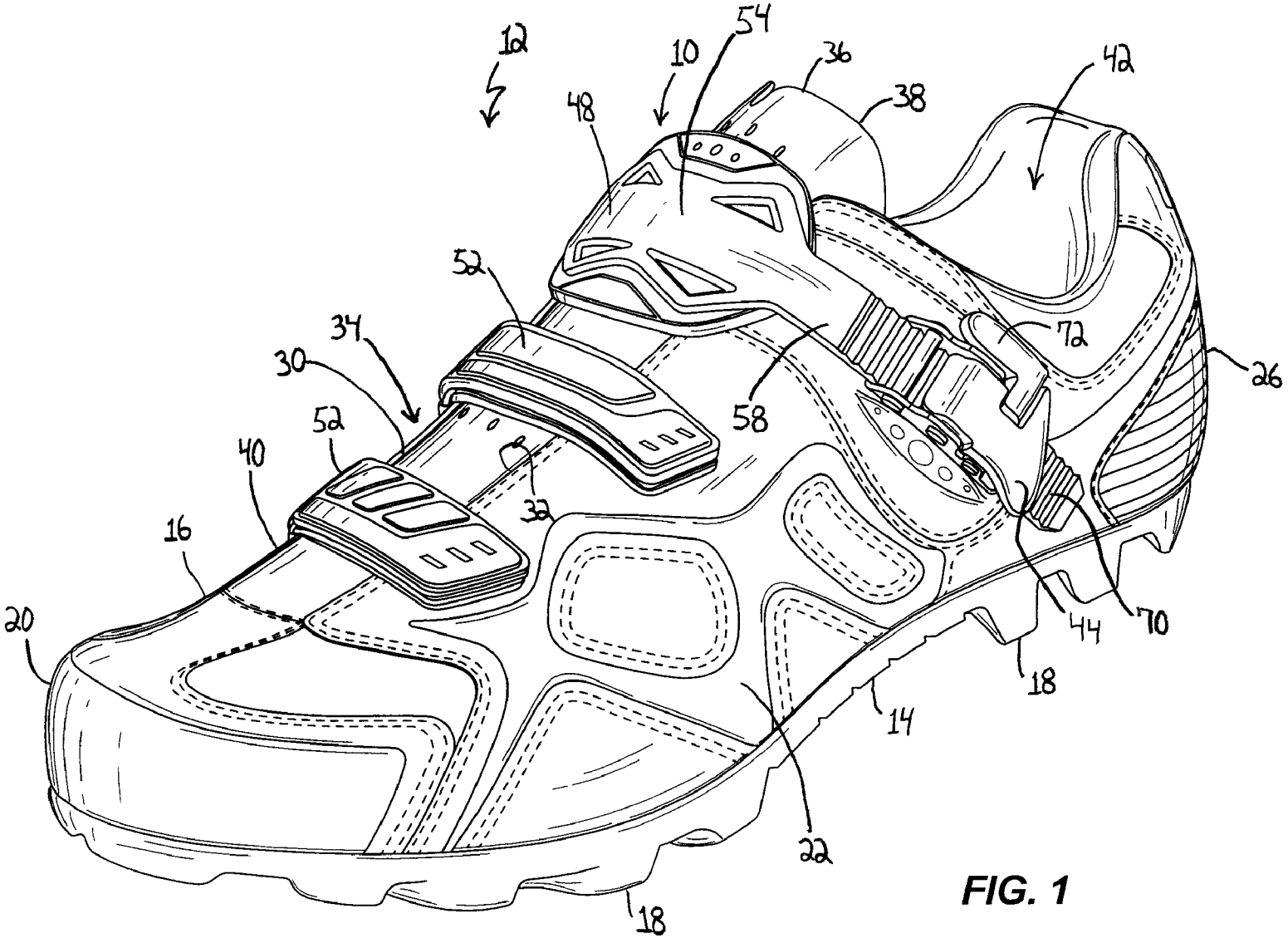
FIG. 1 is a perspective view showing the lateral side of a cycling shoe embodying the present invention.

FIG. 1 illustrates a tightening system 10 for use with a shoe 12. While the shoe 12 illustrated and described herein is a cycling shoe, which is worn by a rider of a bicycle, it should be understood that this is just one possible application of the tightening system 10. In other constructions, the tightening system 10 can be configured for use with a shoe or boot utilized in other applications, such as with skis, skates, etc.

The shoe 12 includes a sole 14 and an upper 16 coupled to the sole 14. The sole 14 can be integrally formed with or coupled to the upper 16 using any suitable method such as gluing, bonding, riveting, fastening, or any suitable mechanism or a combination thereof. While the illustrated sole 14 includes treads 18 that extend from the sole 14, in other constructions, the sole 14 may be relatively flat and may omit the treads 18.

Although not illustrated, as is known by one of skill in the art, the sole 14 can include an exposed or recessed cleat that couples the shoe 12 to a pedal of a bicycle. Furthermore, because the shoe 12 is a cycling shoe, the sole 14 of the shoe 12 is generally stiffer than a sole of a typically shoe for increased pedaling efficiency and comfort for the rider of the bicycle.

Figure 2A:
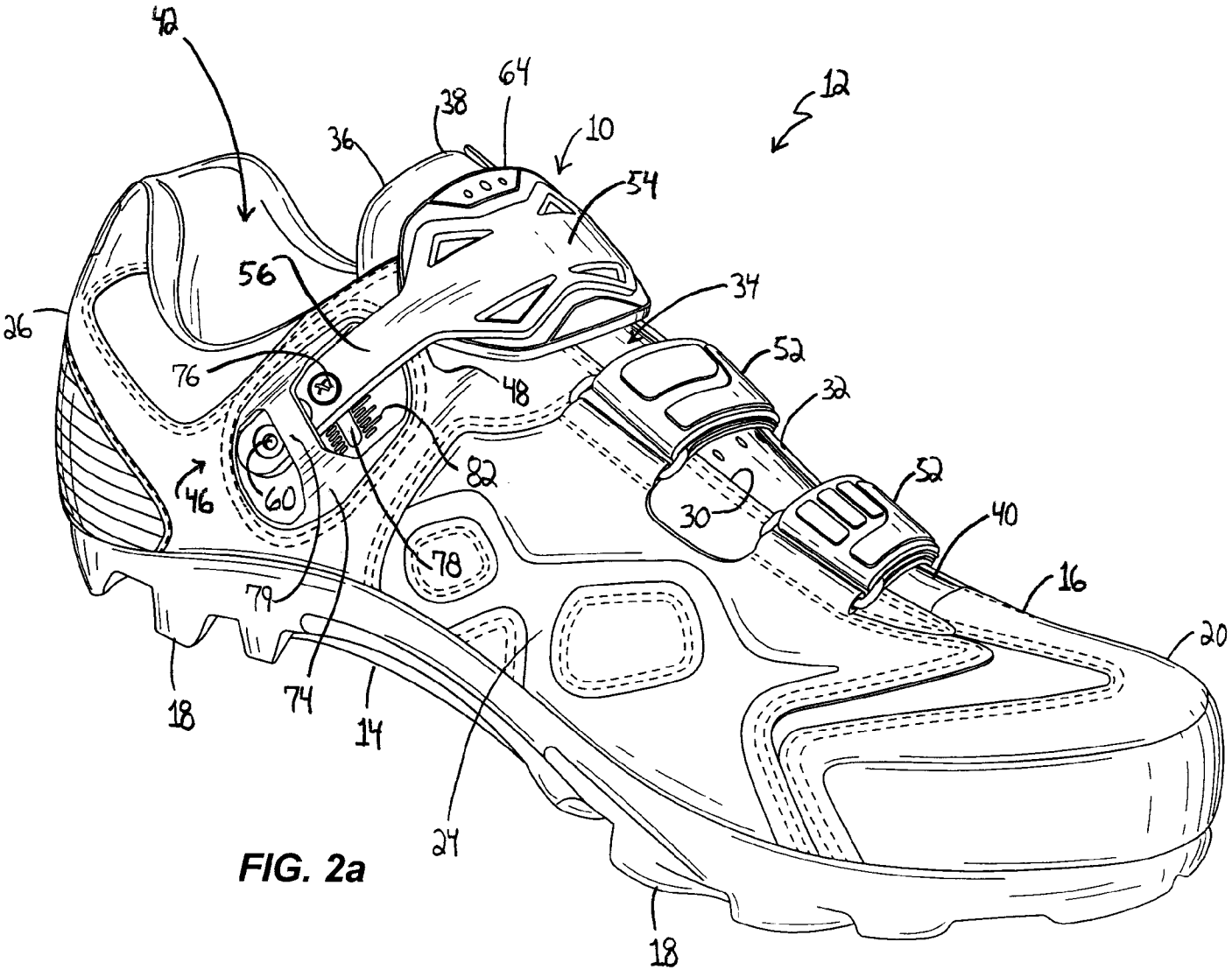
FIG. 2*a* is a perspective view showing the medial side of the cycling shoe of FIG. 1 with a strap in a first position.

Referring to FIGS. 1 and 2*a*, the upper 16 defines a toe box 20, a lateral side 22, a medial side 24, and a heel 26. The toe box 20 is located at the front of the shoe 12 and connects the lateral and medial sides 22, 24 that extend upward from the sole 14. The heel 26, is located at the rear of the shoe 12 and connects the lateral and medial sides 22, 24 of the upper at an end of the shoe opposite the toe box 20. The lateral and medial sides 22, 24 each include an inner edge 30, 32 that define a throat portion 34.

The shoe 12 further includes a tongue 36 having a free end 38 and a fixed end 40. The tongue 36 is coupled to the toe box 20 at the fixed end 40 and extends back toward the heel 26 to cover the throat portion 34, thereby enclosing the upper 16 except for an opening 42. It should be understood that, while the fixed end 40 of the illustrated tongue 36 corresponds with the front of the tongue 36, the tongue 36 could be fixed to the upper 16 along the side, near either of the inner edges 30, 32.

With continued reference to FIGS. 1 and 2*a*, the illustrated tightening system 10 includes a tightening mechanism 44 coupled to the lateral side 22 of the upper 16 (FIG. 1), a strap adjuster member 46 coupled to the medial side 24 of the upper 16 (FIG. 2*a*), and a strap 48 coupled to the tightening mechanism 44 and the strap adjuster member 46. While the illustrated shoe 12 includes auxiliary tightening features 52, which in the illustrated construction are VELCRO straps, in other constructions the shoe may include other suitable auxiliary tightening features or may omit such features. Furthermore, while in the illustrated construction the tightening mechanism 44 is coupled to the lateral side 22 of the upper 16 and the strap adjuster member 46 is coupled to the medial side 24 of the upper 16, in other constructions the tightening mechanism 44 can be coupled to the medial side 24 and the strap adjuster member 46 can be coupled to the lateral side 22.

Figure 3:
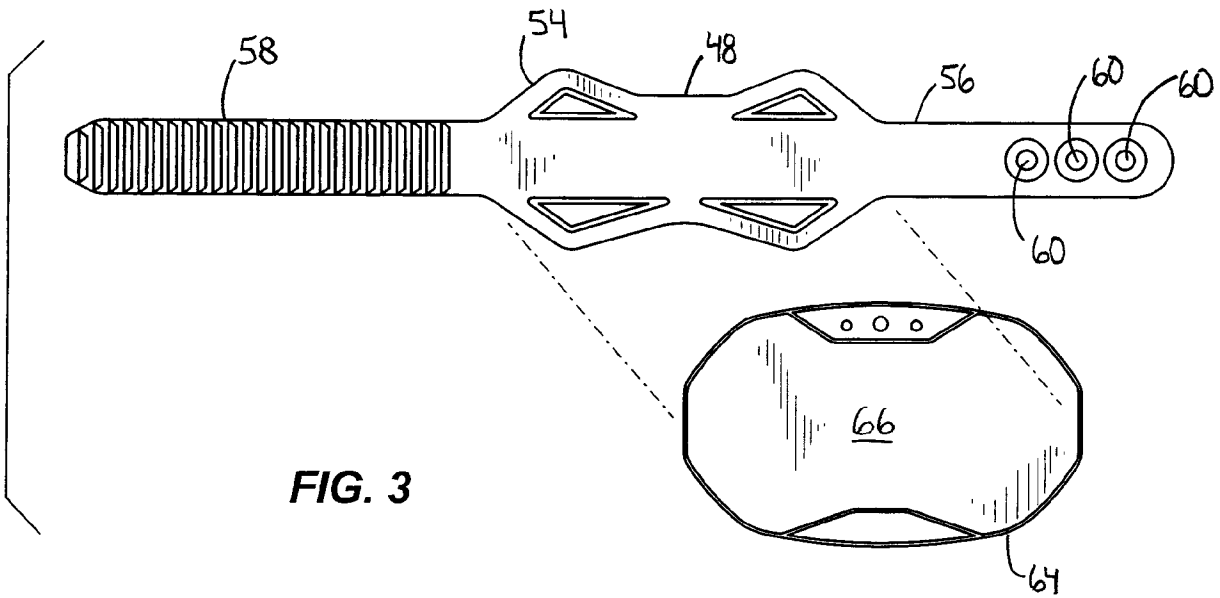
FIG. 3 is an exploded view showing the strap exploded from a pad.
Figure 4:
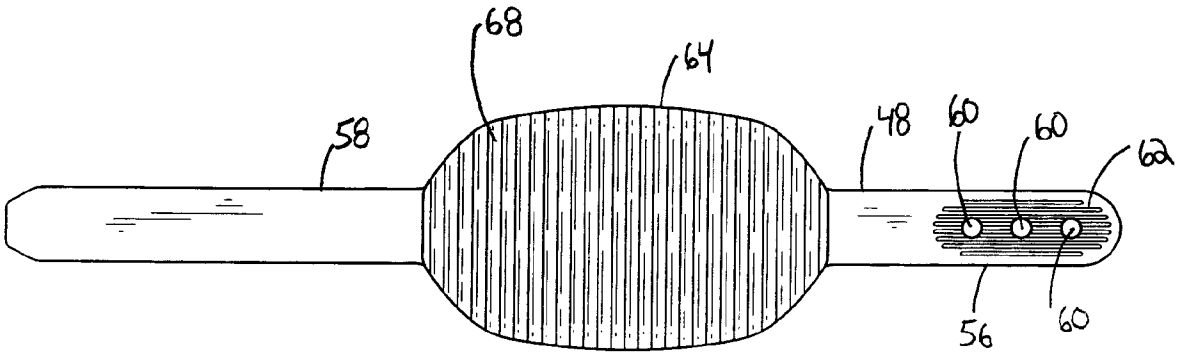
FIG. 4 is a rear view of the strap and the pad.

Referring to FIGS. 3 and 4, the strap 48 includes a throat portion 54, a fixed end portion 56, and a free end portion 58. The fixed and free end portions 56, 58 extend from the throat portion 54 and are typically narrower than the throat portion 54. As illustrated in FIG. 2*a*, the strap 48 is coupled to the shoe 12 such that the throat portion 54 of the strap 48 generally extends across the throat portion 34 of the upper 16. In one construction, the strap 54 can be formed from molded plastic and the like, and in other constructions the strap can be formed from any suitable material.

Referring to FIGS. 3 and 4, a plurality of apertures 60 extend through the fixed end portion 56 of the strap 48. While the illustrated strap 48 includes three apertures 60, in other constructions the strap can include more or less than three apertures 60.

As best illustrated in FIG. 4, a plurality of alignment members 62 are located on a back side of the strap 48, adjacent the apertures 60. The illustrated alignment members 62 are generally evenly spaced upstanding ridges that extend from the strap 48. In one construction, the ridges rise approximately 0.3 mm, and in other constructions the ridges can be any suitable height. In yet other constructions, the strap 48 may omit the alignment members 62 and the back side of the strap 48 can be generally smooth.

A pad 64 is coupled to the throat portion 54 of the strap 48. The illustrated pad 64 includes a front portion 66 (FIG. 3) and a rear portion 68 (FIG. 4). The front portion 66 can be formed from EVA, compressed EVA, and the like, and the rear portion 68 can be formed from lycra textile or any other suitable material. In the illustrated construction, the rear portion 68 of the pad 64 is in-molded to the back of the front portion 66.

Referring to FIG. 1, the illustrated tightening mechanism 44 is a ratchet that receives the free end portion 58 of the strap 48. As is understood by one of skill in the art, the tightening mechanism 44 utilizes ridges 70 formed in the free end portion 58 of the strap 48 to advance the strap 48 through the tightening mechanism 44. In the illustrated construction, the tightening mechanism 44 also includes a ratchet release mechanism 72.

Figure 7:
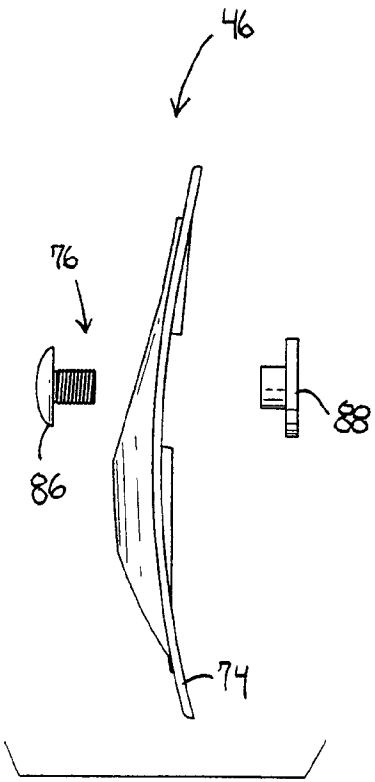
FIG. 7 is a side view of the adjuster member showing a fastener assembly exploded from a base member.
Figure 6:
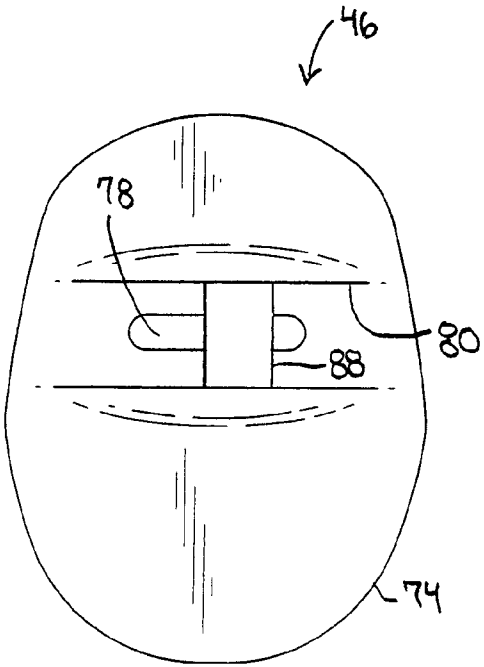
FIG. 6 is a rear view of the adjuster member.
Figure 5:
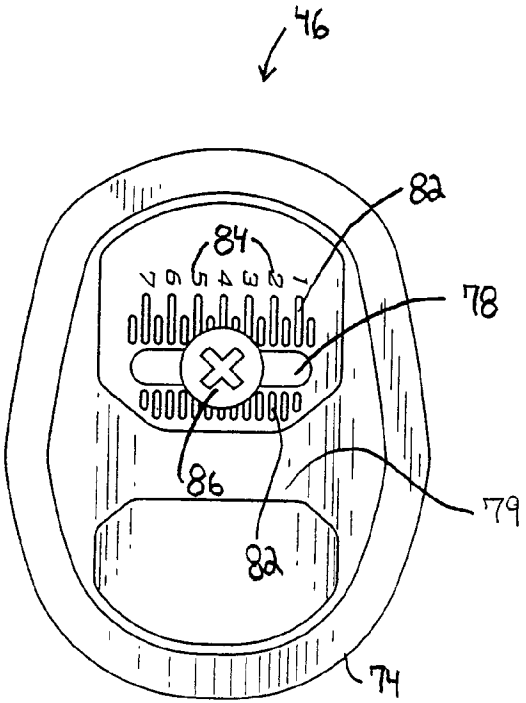
FIG. 5 is a front view of an adjuster member for the strap.

Referring to FIG. 2*a*, the strap adjuster member 46 includes a base member 74 and a fastener assembly 76. As best illustrated in FIGS. 5-7, the base member 74 includes a slot 78 that extends through the base member 74, and a bridge member 79 that extends across the base member 74. A groove 80 is formed on a rear side of the base member 74 and extends generally parallel to the slot 78. A plurality of alignment members 82 are located on a front side of the base member, adjacent the slot 78. The illustrated alignment members 82 are a plurality of generally evenly spaced upstanding ridges that extend from the base member 74. In one construction, the ridges rise approximately 0.3 mm from the base member, and in other constructions the ridges can be any suitable height. Indicia 84, in the form of numbers, is located adjacent the alignment members 82. In yet other constructions, the base member 74 may omit the alignment members 82 and the front side of the base member 74 can be generally smooth.

Referring to FIGS. 2*a* and 7, the illustrated fastener assembly 76 includes a screw 86 and a nut 88. The screw 86 and a portion of the nut 88 extend through the slot 78 to couple the strap 48 to the base member 74 using any one of the apertures 60 of the strap 48. As illustrated in FIGS. 6 and 7, the nut 88 is received within the groove 80 of the base member 74 such that the nut 88 is guided to slide along the rear side of the base member 74 in the direction of the slot 78. The groove 80 also prevents rotation of the nut 88 when the screw 86 is rotated.

Referring to FIGS. 1 and 2*a*, in operation, the user places their foot in the shoe 12 and uses the tightening system 10 to secure the shoe 12 to their foot. The user operates the tightening mechanism 44, which is a ratchet in the illustrated construction, to tighten the strap 48. Depending on the width of the user's foot and the user's preference, the strap 48 can be coupled to the base member 74 using any one of the apertures 60. A different aperture 60 can be used to either shorten or lengthen the strap 48 with respect to the tightening mechanism 44.

In addition, the user can adjust the location of the strap 48 along the length of the throat portion 54 of the upper 16. Adjusting the location of the strap 48 with respect to the upper 16 allows the user to position the strap 48, especially the throat portion 54, at the most desirable and comfortable position for that specific user. In some positions of the strap 48, the user's foot may rub against the throat portion 54 of the strap 48, which may cause discomfort to the user. However, the illustrated shoe 12 includes the strap 48 that is adjustable along the length of the upper 16 to reduce or prevent such discomfort.

Figure 2B:
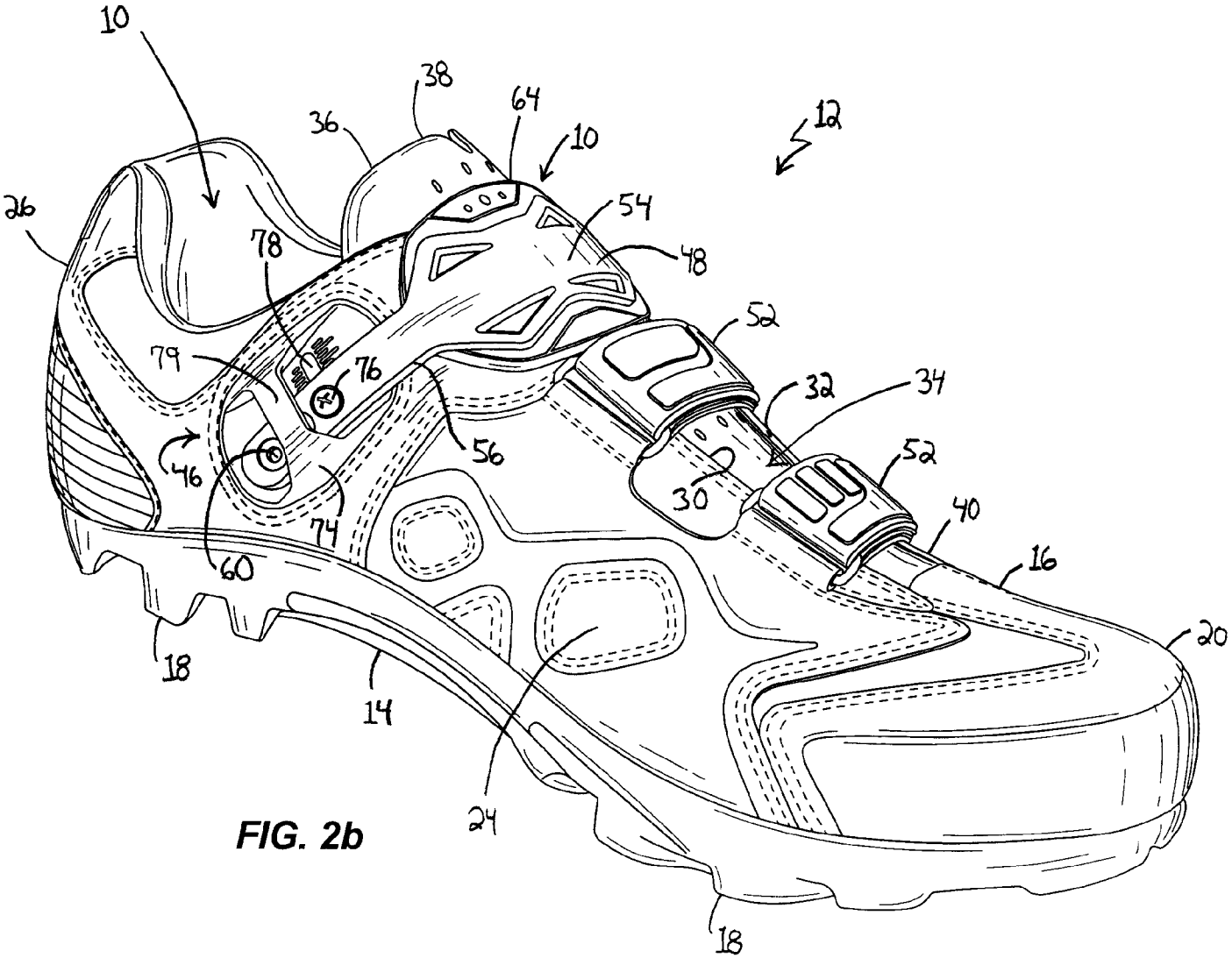
FIG. 2*b* is a perspective view showing the medial side of the cycling shoe of FIG. 1 with the strap in a second position.

Referring to FIGS. 2*a* and 2*b*, the fastener assembly 76 is movable along the slot 78 of the base member 74 to move the strap 48 with respect to the upper 16 and the user's foot. For example, FIG. 2*a* illustrates the fastener assembly 76 and the strap 48 in a first position. Referring to FIG. 2*b* the fastener assembly 76 is movable to a second position that causes the strap 48, including the throat portion 54, to move forward toward the toe box 20 (away from the heel 26) and downward toward the sole 14. To move the fastener assembly 76 and the strap 48, the user loosens the screw 86 and slides the screw 86 and nut 88 within the slot 78. When the strap 48 is in the desired position, the user tightens the screw 86 to secure the strap 48 to the base member 74. The groove 80 formed in the back of the base member 74 (FIG. 6) facilitates tightening the screw 86 by generally preventing rotation of the nut 88.

The alignment members 82 or ridges formed on the base member 74 engage the alignment members 62 or ridges formed on the strap 48 (FIG. 4) to facilitate positioning the strap and fastener assembly 76 within the slot 78. The alignment members 82 of the base member 74 and the strap 48 engage each other to generally prevent movement of the strap 48 within the slot 78 after the fastener assembly 76 has been tightened. In constructions that omit the alignment members 82 of the base member 74 and the alignment members 62 of the strap 48, the strap 48 can pivot about the fastener assembly 76.

The indicia 84 on the base member 74 (FIG. 5) can be used to position the strap 48 in a desired position. For example, the user may know from previous experience which position of the strap 48 is most comfortable for them. Therefore, the user can use the indicia 84 to quickly place the strap 48 in the most desirable position.

While FIG. 2*a* illustrates the fastener 76 and the strap 48 in the farthest rearward and upward position and FIG. 2*b* illustrates the fastener 76 and the strap 48 in the farthest forward and downward position, it should be understood that the fastener 76 and the strap 48 can be located at any position in between.

Various features and advantages of the invention are set forth in the following claims.

What is claimed is:

1. A shoe comprising:

an upper defining a heel;

a strap adjuster member coupled to the upper; and a strap extending across a portion of the upper, the strap coupled to the adjuster member such that at least a portion of the strap is movable in one of a direction toward and away from the heel, wherein the strap includes an alignment member configured to align the strap with respect to the upper in at least one of a first position and a second position, and wherein the alignment member includes ridges formed in the strap, and wherein the upper includes ridges configured to engage the ridges of the strap to generally secure the location of the strap in one of the first and second positions.

2. The shoe of claim 1, wherein the upper defines a toe box and a throat portion that extends generally away from the toe box toward the heel, wherein the strap includes a throat portion that extends across the throat portion of the upper, and wherein the strap is coupled to the adjuster member such that the throat portion of the strap is movable in one of a direction generally toward the toe box and generally toward the heel.

3. The shoe of claim 1, wherein the adjuster member includes a fastener and a base member, wherein the fastener couples the strap to the base member, and wherein the fastener is movable with respect to the base member to move the portion of the strap.

4. The shoe of claim 3, wherein the base member includes a slot that receives the fastener, and wherein the fastener is movable within the slot.

5. The shoe of claim 3, wherein the fastener includes a screw and a nut.

6. The shoe of claim 5, wherein the base member includes a groove that receives the nut to couple the strap to the base member and to generally prevent rotation of the nut.

7. The shoe of claim 6, wherein the strap includes a plurality of apertures that extend through the strap, and wherein at least one of the plurality of apertures receives the fastener.

8. The shoe of claim 3, wherein the strap includes a first end portion and a second end portion, wherein the first end portion is coupled to the adjuster member, and wherein the second end portion is received by a tightening mechanism operable to tighten the strap.

9. The shoe of claim 8, wherein the tightening mechanism is a ratchet.

10. The shoe of claim 1, wherein the adjuster member includes indicia configured to align the strap in a desired position with respect to the adjuster member.

11. A shoe comprising:

an upper defining a heel; and a strap extending across a portion of the upper, the strap coupled to the upper in one of a first position and a second position, the first position closer to the heel than the second position, wherein the strap includes an alignment member configured to align the strap with respect to the upper in at least one of the first position and the second position, wherein the alignment member includes ridges formed in the strap, and wherein the upper includes ridges configured to engage the ridges of the strap to generally secure the location of the strap in one of the first and second positions.

12. The shoe of claim 11, further comprising a sole, wherein the second position is closer to the sole than the first position.

13. The shoe of claim 11, wherein the upper includes a strap adjuster member, the adjuster member including a fastener and a base member, the fastener secures the strap to the base member in one of the first position and the second position.

14. The shoe of claim 13, wherein the base member includes a slot that receives the fastener, and wherein the fastener is movable within the slot to move the strap from the first position to the second position.

15. A shoe comprising:

an upper defining a heel, a first side, and a second side;

a strap adjuster member coupled to the upper and at least a portion of the adjuster member is movable from a first position to a second position, the first position closer to the heel that the second position;

a strap extending across the upper from the first side to the second side, the strap including a first end portion and a second end portion; and a tightening mechanism coupled to the first side of the upper, the tightening mechanism operable to tighten the strap, wherein the first end portion of the strap is received by the tightening mechanism, wherein the second end portion of the strap is coupled to the adjuster member such that the second end portion is movable with the portion of the adjuster member from the first position to the second position, wherein the second end portion of the strap includes an alignment member configured to align the strap with respect to the upper in at least one of the first position and the second position, and wherein the alignment member includes ridges formed in the second end portion of the strap, and wherein the adjuster member includes ridges that engage the ridges of the strap to generally secure the location of the second end portion of the strap with respect to the upper in one of the first position and the second position.

16. The shoe of claim 15, wherein the adjuster member includes a fastener and a base member, the fastener couples the second end portion of the strap to the adjuster member such that the strap is movable from the first position to the second position.

* * * * *

UNITED STATES PATENT AND TRADEMARK OFFICE

CERTIFICATE OF CORRECTION

PATENT NO. : 7,533,478 B2
APPLICATION NO. : 11/383992
DATED : May 19, 2009
INVENTOR(S) : Carl Bird et al.

It is certified that error appears in the above-identified patent and that said Letters Patent is hereby corrected as shown below:

Col. 6;

Claim 15, line 21:

change “the heel that the second position;” to --the heel than the second position;--

Signed and Sealed this

Twenty-first Day of July, 2009

John Doll

JOHN DOLL
*Acting Director of the United States Patent and Trademark Office*